US005791872A

United States Patent [19]

Owen

[11] Patent Number: 5,791,872

[45] Date of Patent: Aug. 11, 1998

[54] BLADE TIP CLEARENCE CONTROL APPARATUS

[75] Inventor: Brian C. Owen, Derby, Great Britain

[73] Assignee: Rolls-Royce Inc., Reston, Va.

[21] Appl. No.: 837,819

[22] Filed: Apr. 22, 1997

[51] Int. Cl.[6] ..... F04D 29/54

[52] U.S. Cl. ..... 415/173.2

[58] Field of Search ..... 415/173.1, 173.2, 415/173.3, 134–139

[56] References Cited

U.S. PATENT DOCUMENTS

| | | | |
|---|---|---|---|
| 4,728,257 | 3/1988 | Handschuh | 415/173.1 |
| 5,054,997 | 10/1991 | Corsmeier et al. | 415/173.2 |
| 5,127,793 | 7/1992 | Walker et al. | 415/173.1 |
| 5,154,578 | 10/1992 | Miraucourt et al. | 415/173.3 |
| 5,219,268 | 6/1993 | Johnson | 415/115 |
| 5,314,303 | 5/1994 | Charbonnel et al. | 415/173.1 |
| 5,639,210 | 6/1997 | Carpenter et al. | 415/173.3 |

*Primary Examiner*—John T. Kwon
*Attorney, Agent, or Firm*—Oliff & Berridge, PLC

[57] ABSTRACT

A blade tip clearance control apparatus (10) comprises a plurality of circumferentially arranged spaced wall members (16) located adjacent the rotor path of a plurality of rotor blades (14). Each wall member (16) is mounted on a carrier (18) attached to an annular casing (22) radially outward thereof. Thermal expansion or contraction of the carrier (18) causes radial movement of the wall members (16). The wall members (16) have at least one fluid passage (20) therein. In operation a flow of fluid passing through the fluid passages (20) causes either thermal expansion or contraction of the wall member (16) to different radial positions.

8 Claims, 3 Drawing Sheets

BLADE TIP CLEARENCE CONTROL APPARATUS

The present invention relates to a blade tip clearance control apparatus for use with a gas turbine engine. In particular the present invention is concerned with providing a clearance control apparatus for a gas turbine engine to control the clearance between a casing or static portion of the engine and the tips of the blades in a rotor.

It is important to keep the clearance between the tips of the rotating blades and a static portion, such as the radially inner surface of an annular casing to a minimum. The clearance is controlled to minimise the leakage of turbine gases between the casing and the tips of the blades. Minimising the leakage of the gases improves the engine efficiency and thereby reduces the specific fuel consumption of the engine.

During the conventional operating cycle of a gas turbine engine the blades, and the discs on which they are mounted, expand due to centrifugal forces acting on them as they rotate at high speeds and by thermal expansion due to being heated by the working fluid passing therethrough. The annular casing also heats up and grows radially outwards resulting in an increase in the tip clearance between the tips of the blades and the casing.

The present invention seeks to provide a blade tip clearance control apparatus which reduces the increase in the tip clearance between the blades and the casing during engine operation.

According to the present invention a blade tip clearance control apparatus comprises a plurality of circumferentially arranged spaced wall members located adjacent the rotor path of a plurality of blades, each wall member having a carrier which extends radially outward to connect the wall member to an annular support structure, whereby in operation thermal expansion or contraction of the carriers causes the wall members to move to different radial positions.

Preferably the wall members are mounted on the carriers which are made from a material having a higher coefficient of thermal expansion than the annular support structure.

The carrier may consist of a plurality of conduits or have at least one fluid passage therein, whereby in operation a flow of fluid passing through the conduits or fluid passages controls the thermal expansion or contraction of the carrier to move the wall member to a different radial position.

Preferably each carrier and wall member has a plurality of fluid passages therein. The fluid passages may be spiral to increase the residence time of the fluid passing therethrough and the carrier may be thermally insulated.

The present invention will now be described with reference to the accompanying drawings in which.

Figure 1:
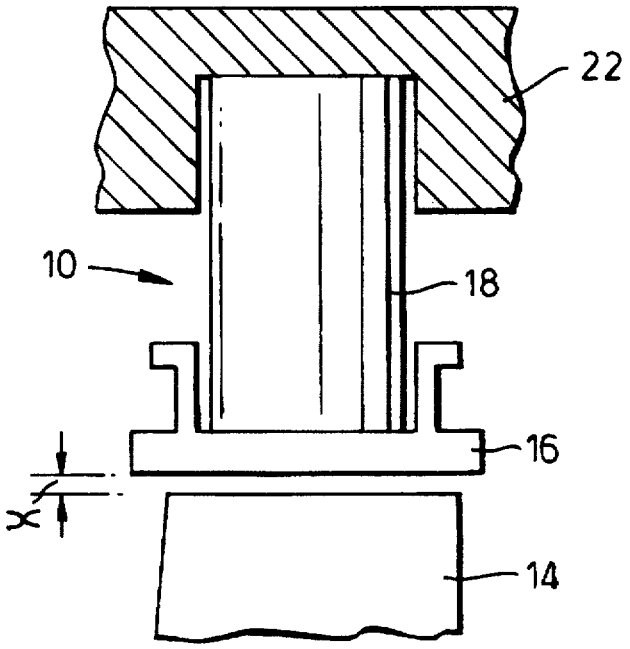
FIG. 1 is a cross-sectional view of a tip clearance control apparatus in accordance with one embodiment of the present invention.

Referring to FIG. 1 a gas passage is defined between rotor blades 14 and wall members in the form of a plurality of segments 16. The segments 16 form part of a blade tip clearance control apparatus generally indicated at 10. The function of the apparatus 10 is to control the clearance x between the tips of the blades 14 and the segments 16 in a predetermined and controlled manner.

Each segment 16 is mounted on a carrier 18 which is attached to casing 22. Any radial growth of the casing 22 due to thermal expansion causes the carriers 18 and the segments 16 to move radially outward. The carrier 18 however is made from a material which has a higher coefficient of thermal expansion than the casings 22. The length of the carrier 18 is also such that the change in length of the carrier 18 due to thermal expansion is greater than the change in the clearance x caused by the thermal expansion of the casing 22 and the tips of the blades 14. The carrier 18 thus moves the segments 16 radially inward to reduce the clearance x.

It will be appreciated by one skilled in the art that the length of the carrier and the coefficient of thermal expansion of the material from which it is made can be chosen for a particular application to control the clearance x.

Figure 2:
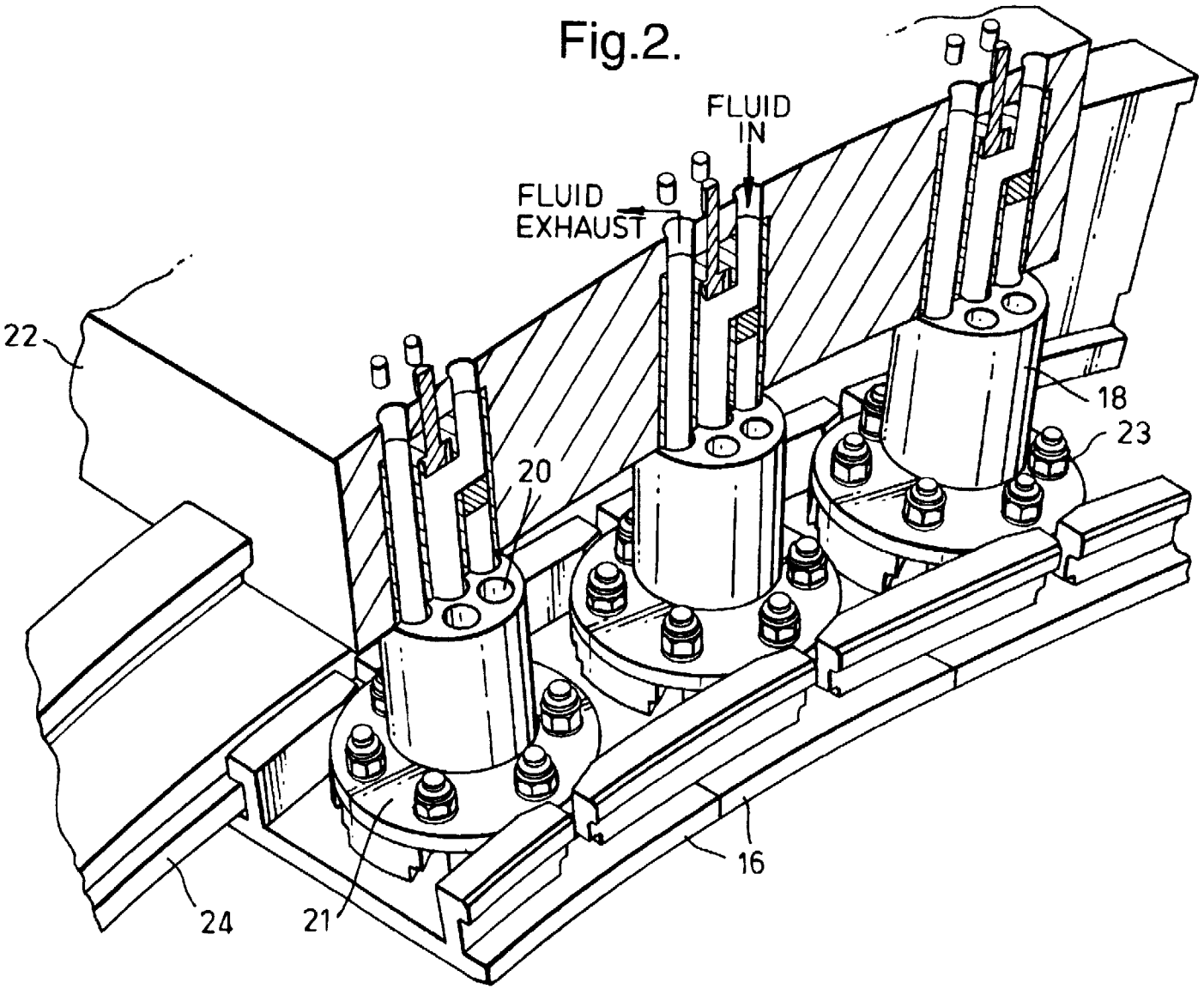
FIG. 2 is a pictorial view, partially broken away, of part of a tip clearance apparatus in accordance with a second embodiment of the present invention.
Figure 3:
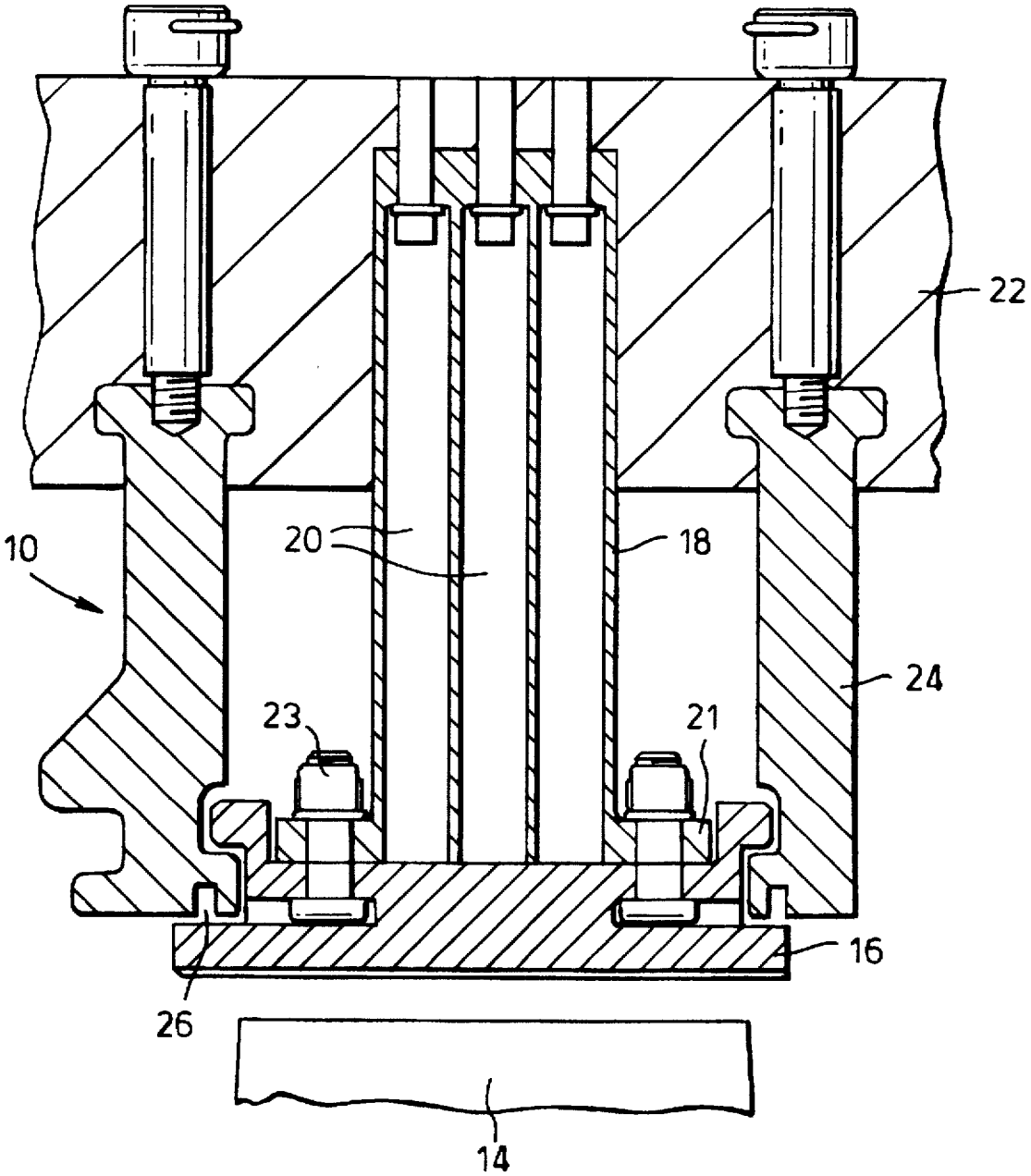
FIG. 3 is a cross-sectional view of a tip clearance control apparatus as shown in FIG. 2.

In the second embodiment of the present invention shown in FIGS. 2 and 3 the carrier 18 is provided with a plurality of fluid passageways 20. The wall segments 16 are made separately from the carriers 18 and bolts 23 fasten the segments 16 to flanges 21 provided at the radially inner end of the carriers 18.

Isolation rings 24 are also attached to the casing 22. The isolation rings 24 do not locate the carriers 18 or the segments 16 unless there is a failure. In the event of a failure the isolation rings 24 prevent movement of the carriers 18 and/or the segments 16 radially inwards into the gas path. Seals (not shown) are inserted into the spaces 26 between the isolation rings 24 and the segments 16. The seals prevent the leakage of gas into and out of the gas path.

In operation a flow of fluid is passed through a hole in the casing 22 and fed down the central passageway 20 in the carrier 18 to the segment 16. The fluid either impinges upon the segment 16 or is fed into a cavity (not shown) in the segment 16. The fluid then exhausts from the carrier 18 through the passageways 20 around the periphery of the carrier 18 before passing into the main exhaust stream through a further hole in the casing 22. Although in the preferred embodiment of the present invention single holes are used to pass the fluid into and out of the casing 22 it will be appreciated that multiple holes may be used.

The build clearance between the tips of the blades 14 and the segments 16 is sufficient to accommodate transient growth of the tips of the rotor blades 14 and the casing 22. To maintain this clearance during transient conditions a fluid passes through the passageways 20 to cool the carrier 18 and prevent movement of the segments 16 radially inwards.

Once the tips of the rotor blades 14 and the casing 22 have reached their final steady state growth the fluid in the passageways 20 has been heated. The heated fluid feeds through the passageways 20 which cause the carriers 18 and the corresponding segments 16 to grow radially inwards. The segments 16 move radially inwards to minimise the clearance between the blade tips and the segments 16 at steady state conditions.

In the preferred embodiment of the present a single fluid, such as air or steam, is used in a closed loop system whereby the fluid is heated as it passes through the carriers during operation. However it will be appreciated that alternatives to the closed loop system described could be used. For example the fluid may be heated externally of the carriers or separate fluids could be used for cooling and heating the carriers, means being provided to switch between the cooling or heating fluids.

A tip clearance apparatus 10 in accordance with the present invention can be tuned to give the required response.

The rate of flow of fluid through the passageways 20, the fluid used, the length of the passageways 20 or the material from which the carrier 18 is made can be varied to give the required clearance control.

It is also envisaged that the passageways 20 could spiral through the carrier 18 which would increase the residence time of the fluid flow passing therethrough to achieve more uniform thermal expansion or contraction of the carrier 18.

Figure 4:
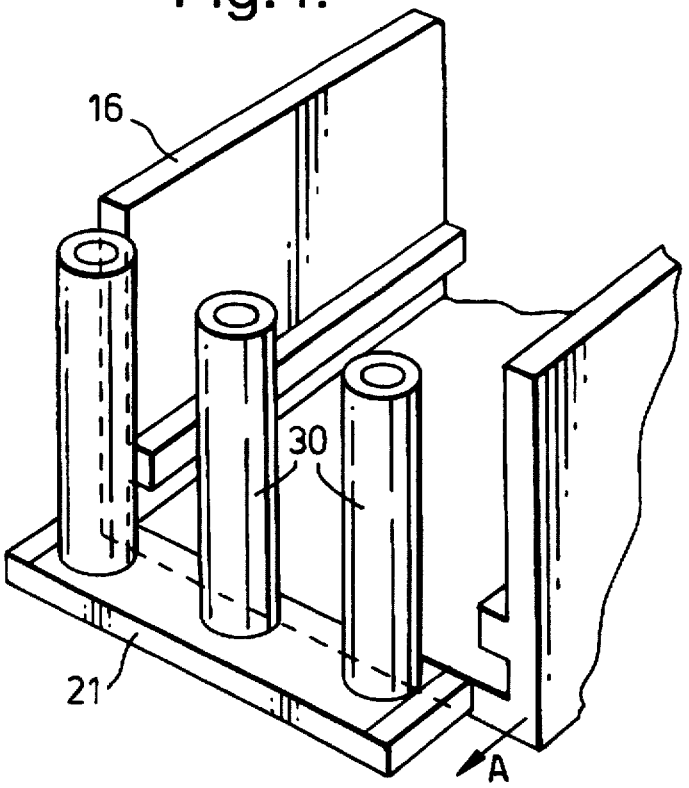
FIG. 4 is a pictorial view of part of a tip clearance apparatus in accordance with a third embodiment of the present invention.

Instead of using a solid carrier 18 with passageways 20 as shown in FIGS. 2 and 3 the carrier could consist of a plurality of individual conduits 30 through which the fluid would pass, FIG. 4. The conduits 30 could be insulated to prevent thermal growth during transients. The thermal lagging (not shown) would be such that the conduits 30 would cause growth of the carrier 18 radially inwards only after the transient rotor and casing growths have taken place.

In the embodiment shown in FIG. 4 the wall member 16 is mounted on the carrier 18 by sliding the wall member in the direction of arrow A over flange 21 attached to the bottom of the conduits 30.

I claim:

1. A blade tip clearance control apparatus comprising a plurality of circumferentially arranged spaced wall members located adjacent the rotor path of a plurality of blades, each wall member having a carrier which extends radially outward to connect the wall member to an annular support structure, whereby in operation thermal expansion or contraction of the carriers causes the wall members to move to different radial positions.

2. A blade tip clearance apparatus as claimed in claim 1 in which the carrier has a higher coefficient of thermal expansion than the annular support structure.

3. A blade tip clearance control apparatus as claimed in claim 2 in which the wall members are mounted on the radially inner end of the carrier.

4. A blade tip clearance apparatus as claimed in claim 1 in which the carrier comprises a plurality of hollow conduits whereby in operation a flow of fluid passes through the hollow conduits to control the thermal expansion or contraction of the conduits to move the wall member to a different radial position.

5. A blade tip clearance apparatus as claimed in claim 4 in which the hollow conduits are thermally insulated.

6. A blade tip clearance apparatus as claimed in claim 1 in which each carrier and wall member has at least one fluid passage therein, whereby in operation a flow of fluid passes through the fluid passages to control the thermal expansion or contraction of the carrier to move the wall member to a different radial position.

7. A blade tip clearance apparatus as claimed in claim 6 in which each carrier and wall member has a plurality of fluid passages therein.

8. A blade tip clearance apparatus as claimed in 7 in which the passageways are spiral to increase the residence time of the fluid passing therethrough.

* * * * *